US005320177A

United States Patent [19]

Shibata et al.

[11] Patent Number: 5,320,177

[45] Date of Patent: Jun. 14, 1994

[54] POWER DRIVEN HAMMER DRILL

[75] Inventors: Mitsuyoshi Shibata, Nishio; Masao Miwa, Ichinomiya, both of Japan

[73] Assignee: Makita Corporation, Anjo, Japan

[21] Appl. No.: 37,936

[22] Filed: Mar. 26, 1993

[30] Foreign Application Priority Data

Mar. 30, 1992 [JP] Japan ..... 4-026921
Aug. 11, 1992 [JP] Japan ..... 4-062330

[51] Int. Cl.[5] ..... B25D 11/10

[52] U.S. Cl. ..... 173/48; 173/109; 173/201

[58] Field of Search ..... 173/47, 48, 109, 201, 173/205

[56] References Cited

U.S. PATENT DOCUMENTS

| | | | |
|---|---|---|---|
| 3,876,014 | 4/1975 | Moores, Jr. | 173/47 |
| 4,657,088 | 4/1987 | Grossmann et al. | 173/48 X |
| 4,895,212 | 1/1990 | Wache | 173/48 |
| 4,998,588 | 3/1991 | Manschitz | 173/47 |
| 5,036,925 | 8/1991 | Wache | 173/48 |
| 5,052,497 | 10/1991 | Houben et al. | 173/109 |

FOREIGN PATENT DOCUMENTS

| | | |
|---|---|---|
| 61-172786 | 10/1986 | Japan . |
| 2085345 | 4/1982 | United Kingdom . |

*Primary Examiner*—Rinaldi Rada
*Attorney, Agent, or Firm*—Lahive & Cockfield

[57] ABSTRACT

The invention provides an improved intermediate housing incorporated in a power driven hammer drill, which is light in weight, easily and safely handled, and uncostly manufactured. The intermediate housing of the invention includes a bearing member and a cylindrical piston housing member which are integrally composed of a synthetic resin having high tenacity and excellent heat resistance and wear resistance. The intermediate housing further includes a plurality of ribs radially extending from the piston housing member to give a sufficient strength durable to a stress applied onto the piston housing member. In the intermediate housing thus constructed, the bearing member has at least one opening for feeding an air flow generated by a fan while the piston housing member includes at least one air conduit for circulating the air flow. This structure efficiently prevents overheat and thermal deformation of the piston housing member and the bearing member in continuous operation of the hammer drill.

9 Claims, 9 Drawing Sheets

POWER DRIVEN HAMMER DRILL

BACKGROUND OF THE INVENTION

1. Field of the Invention

The present invention relates to an internal structure of a power driven hammer drill, and more specifically to an intermediate housing disposed between a gear housing and a motor housing.

2. Description of the Related Art

A power driven hammer drill generally includes an intermediate housing arranged between a gear housing and a motor housing as disclosed in Japanese Utility Model Laying-Open Gazette No. 61-172786 by the applicant of the present invention. FIG. 9 schematically shows a typical example of such conventional power driven hammer drills. The hammer drill includes an intermediate housing 204 positioned between a gear housing 202 and a motor housing 203. The intermediate housing 204 consists of a bearing member 241 for supporting an armature shaft 206 of a motor 205 and an intermediate shaft 207 and separating a piston cylinder 232 from the motor 205, and a cylindrical piston housing member 242 protruded from the bearing member 241 for supporting a rotating tool holder 230 and a reciprocating piston cylinder 232.

The intermediate housing is required to have sufficient strength and durability, and is generally composed of a metal such as aluminum as disclosed in UK Patent Application GB 2085345.

In the conventional metal intermediate housing described above, the bearing member 241 and the piston housing member 242 are separately manufactured and assembled later, which increases both the cost and labor and makes the hammer drill undesirably heavy. Metal outer faces 204*a* of the intermediate housing 204 exposed to the atmosphere may cause electric shocks.

Another structure of an intermediate housing is disclosed in UK Patent Application GB 2085345, in which a bearing member and a piston housing member are integrally composed of aluminum. The metal intermediate housing of this structure also makes the hammer drill undesirably heavy to prevent smooth operation of the hammer drill, and requires excessive works for making bores and holes, which increase the manufacturing cost and labor. Inside the aluminum housing member is generally covered with iron or another metal to improve the durability, which further increases the manufacturing cost. The metal intermediate housing is accommodated in a plastic housing to prevent possible electric shocks, which enlarges the outer diameter of the hammer drill.

SUMMARY OF THE INVENTION

One object of the invention is thus to provide an improved power driven hammer drill which is light in weight and easily and safely handled.

Another object of the invention is to provide a power driven hammer drill including an intermediate housing which is manufactured uncostly through relatively simple steps.

Still another object of the invention is to provide a power driven hammer drill including an intermediate housing which is free from thermal deformation even in continuous operation.

The above and other related objects are realized by a power driven hammer drill of the invention, which includes: an electric motor; a tool holder for supporting a tool bit and transmitting a rotation of the electric motor to the tool bit via a driving mechanism including an armature shaft of the electric motor, plural gear elements, and an intermediate shaft; a piston cylinder slidably movable along an axis of the power driven hammer drill; an air cushion percussive mechanism for converting a rotary movement of the electric motor to a reciprocating movement of the piston cylinder and transmitting the reciprocating movement to the tool bit as an axial impact force; and an externally accessible switching mechanism for switching off the air cushion percussive mechanism.

The power driven hammer drill of the invention further includes an intermediate housing disposed between a gear housing and a motor housing. The intermediate housing consists of a bearing member for supporting the armature shaft of the electric motor and the intermediate shaft, and a cylindrical piston housing member for holding the tool holder and the piston cylinder. The bearing member and the cylindrical piston housing member of the intermediate housing are integrally composed of a synthetic resin.

The synthetic resin used in the invention has desirable mechanical properties including high tenacity and excellent heat resistance and wear resistance: for example, a glass fiber-reinforced polyamide resin.

The intermediate housing further includes a plurality of ribs radially and integrally protruding from an outer face of the cylindrical piston housing member. The plurality of ribs facing to an inner wall of the gear housing with a little space held therebetween.

The intermediate housing of the invention is integrally composed of a synthetic resin. This structure efficiently saves labor and cost required for manufacturing a conventional intermediate housing composed of a metal, and reduces the weight of the power driven hammer drill. The synthetic resin of the outer-most part of the intermediate housing exposed to the atmosphere effectively prevents electric shocks and allows easy and safe operation of the power driven hammer drill. The plurality of ribs attached to the piston housing member give a sufficient strength durable to a stress applied onto the intermediate housing in operation of the power driven hammer drill.

In another application of the invention, a power driven hammer drill includes: an electric motor; a fan for cooling the electric motor; a tool holder for supporting a tool bit and transmitting a rotation of the electric motor to the tool bit via a driving mechanism comprising an armature shaft of the electric motor, plural gear elements, and an intermediate shaft; a piston cylinder slidably movable along an axis of the power driven hammer drill; an air cushion percussive mechanism for converting a rotary movement of the electric motor to a reciprocating movement of the piston cylinder and transmitting the reciprocating movement to the tool bit as an axial impact force; and an externally accessible switching mechanism for switching off the air cushion percussive mechanism.

The power driven hammer drill further includes an intermediate housing disposed between a gear housing and a motor housing. The intermediate housing consists of a bearing member for separating the gear housing from the motor housing and for supporting the armature shaft of the electric motor and the intermediate shaft, and of a cylindrical piston housing member protruded from the bearing member for holding the tool holder and the piston cylinder. The bearing member has at least one opening for feeding an air flow generated by the fan to the cylindrical piston housing member, and the cylindrical piston housing member having at least one air conduit for circulating the air flow fed through the opening.

At least one thicker wall portion having a hollow inside thereof is attached to an outer face of the piston housing member. The hollow connects with the opening of the bearing member and includes an air inlet, an air outlet separated from the air inlet by a partition plate, and an intermediate opening to form a U-shaped air conduit for circulating the air flow.

The air flow generated by the fan enters the hollow formed in the thicker wall portion through the opening of the bearing member. The air flow circulates in the thicker wall portion and continuously cools the cylindrical piston housing member to prevent overheat of the piston housing member and the bearing member. This structure of the invention efficiently prevents thermal deformation of the piston housing member in continuous operation of the power driven hammer drill.

In this structure, the bearing member and the cylindrical piston housing member of the intermediate housing may be integrally composed of a synthetic resin, which has excellent mechanical properties including high tenacity, heat resistance, and wear resistance.

These and other objects, features, aspects, and advantages of the present invention will become more apparent from the following detailed description of the preferred embodiment with the accompanying drawings.

DESCRIPTION OF THE PREFERRED EMBODIMENTS

Figure 1:
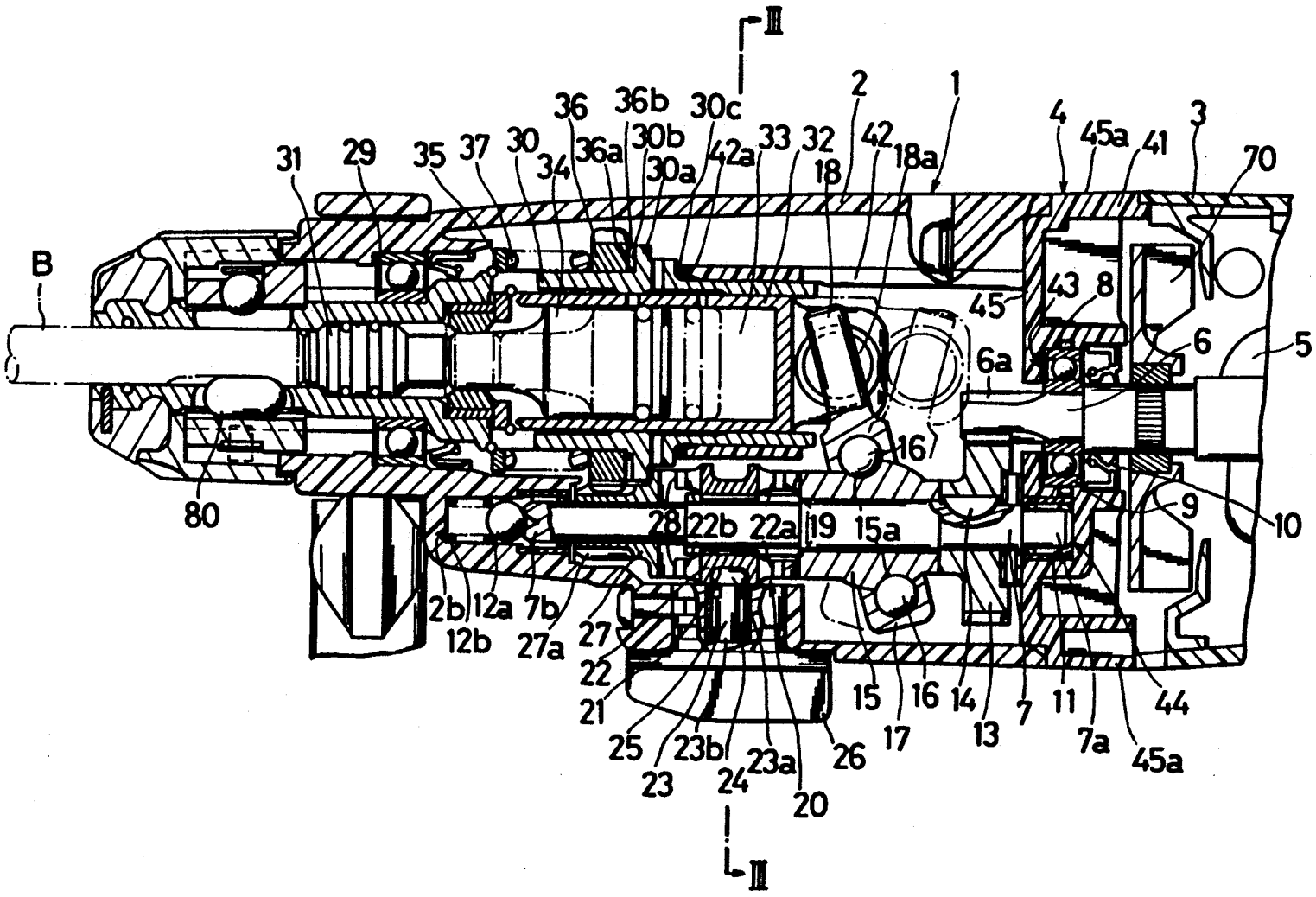
FIG. 1 is a partially sectional view showing a power driven hammer drill embodying the invention.

FIG. 1 is a partially sectional view showing a power driven hammer drill 1 embodying the invention. In the power driven hammer drill 1, rotation of a motor 5 is transmitted to an intermediate shaft 7 via a motor pinion 6*a* of an armature shaft 6 and a first gear element 13 and then to a third gear element 36 engaging with a pinion 27*a* of a second gear element 27 of the intermediate shaft 7 so as to rotate a tool bit B via a tool holder 30. The rotary movement of the intermediate shaft 7 is further transmitted via a clutch mechanism 20 to a boss member 15, which, in cooperation with a wobble arm 18, converts the rotary movement to an axially reciprocating movement of a piston cylinder 32. The reciprocating movement of the piston cylinder 32 generates a likewise axial to-and-fro movement of a striker 34 through an air cushion formed between an air chamber 33 and the striker 34, and is finally transmitted via a percussive element 31 to the tool bit B as an axial impact force.

In the above power driven hammer drill 1, an intermediate housing 4 is bolted between a gear housing 2 and a motor housing 3 as clearly seen in FIG. 1. The intermediate housing 4 consists of a bearing member 41 for supporting the armature shaft 6 and the intermediate shaft 7, and a cylindrical piston housing member 42 for holding the tool holder 30 and the piston cylinder 32. The bearing member 41 and the cylindrical piston housing member 42 are integrally composed of a glass fiber-reinforced polyamide resin, which has desirable mechanical properties including high tenacity and excellent heat resistance and wear resistance. The bearing member 41 has, on its approximate center, a first bearing seat 43 for accommodating a ball bearing 9 and an oil seal 10 for supporting the armature shaft 6 via a washer 8. The bearing member 41 also has a second bearing seat 44 arranged below the first bearing seat 43. The second bearing seat 44 supports one end 7*a* of the intermediate shaft 7 through function of a needle bearing 11. The other end 7*b* of the armature shaft 7 is inserted into a bore 2*b* of the gear housing 2 and pressed against the second bearing seat 44 by a spring 12*b* via a ball 12*a*. This structure efficiently reduces uncomfortable vibration and noise due to rotation of the intermediate shaft 7 in operation of the power driven hammer drill 1.

The first gear element 13 engages with the motor pinion 6*a* of the armature shaft 6 and is fixed with a key 14. The intermediate shaft 7 is idlingly fitted in the boss member 15, which has circumferential grooves 15*a* for supporting a pivotably movable ring 17 via a plurality of balls 16. The wobble arm 18 is integrally formed with and protrudes from the ring 17. The boss member 15 is further provided with first engagement claws 19, which are arranged opposite to second engagement claws 28 formed on the second gear element 27 positioned across the clutch mechanism 20 from the boss member 15.

The clutch mechanism 20 includes an axially slidable clutch 22, which is coupled with the intermediate shaft 7 by a spline structure and has a track 21 on the circumference thereof, and an eccentric pin 23 fitted into the track 21. The clutch 22 has, on both ends thereof, first clutch teeth 22*a* and second clutch teeth 22*b* which respectively engage with the first engagement claws 19 of the boss member 15 and the second engagement claws 28 of the second gear element 27. The axially sliding movement of the clutch 22 is defined between the boss member 15 and the second gear element 27 by engagement of first or second clutch teeth 22*a* or 22*b* with the first engagement claws 19 or the second engagement claws 28. A head 23*a* of the eccentric pin 23 is inserted into the track 21 in a direction perpendicular to the intermediate shaft 7, and is held in a pin seat 25 by a needle bearing 24. A body 23*b* of the eccentric pin 23 is rotatably fixed to a switching lever 26.

As clearly seen in FIG. 1, the cylindrical piston housing member 42 of the intermediate housing 4 holds the tool holder 30 which is supported by a ball bearing 29 on its forward (leftward in FIG. 1) portion. One end 42*a* of the piston housing member 42 is in contact with a cushion washer 30c. The tool holder 30 supports the slidably moving percussive element 31 in the forward portion thereof, and the slidably moving piston cylinder 32, which is coupled with the wobble arm 18 via a piston pin 18a, in the rear portion thereof. The air chamber 33 and the slidably moving striker 34 are disposed in the piston cylinder 32.

A rotary movement of the motor 5 is transmitted to the tool holder 30 via the third gear element 36 which is idlingly attached to outside of the tool holder 30. The third gear element 36 engages with the pinion 27a of the second gear element 27 and is pressed backward (rightward in FIG. 1) by a spring 37 fixed to a washer 35. A rear face 36a of the third gear element 36 includes a first clutch face 36b engaging with a second clutch face 30b formed on a front side wall of a flange 30a on a rear end of the tool holder 30. When an excessive load of the tool bit B is applied onto the tool holder 30, the first clutch face 36b of the third gear element 36 is disengaged from the second clutch face 30b of the tool holder 30 to race the third gear element 36.

Figure 2:
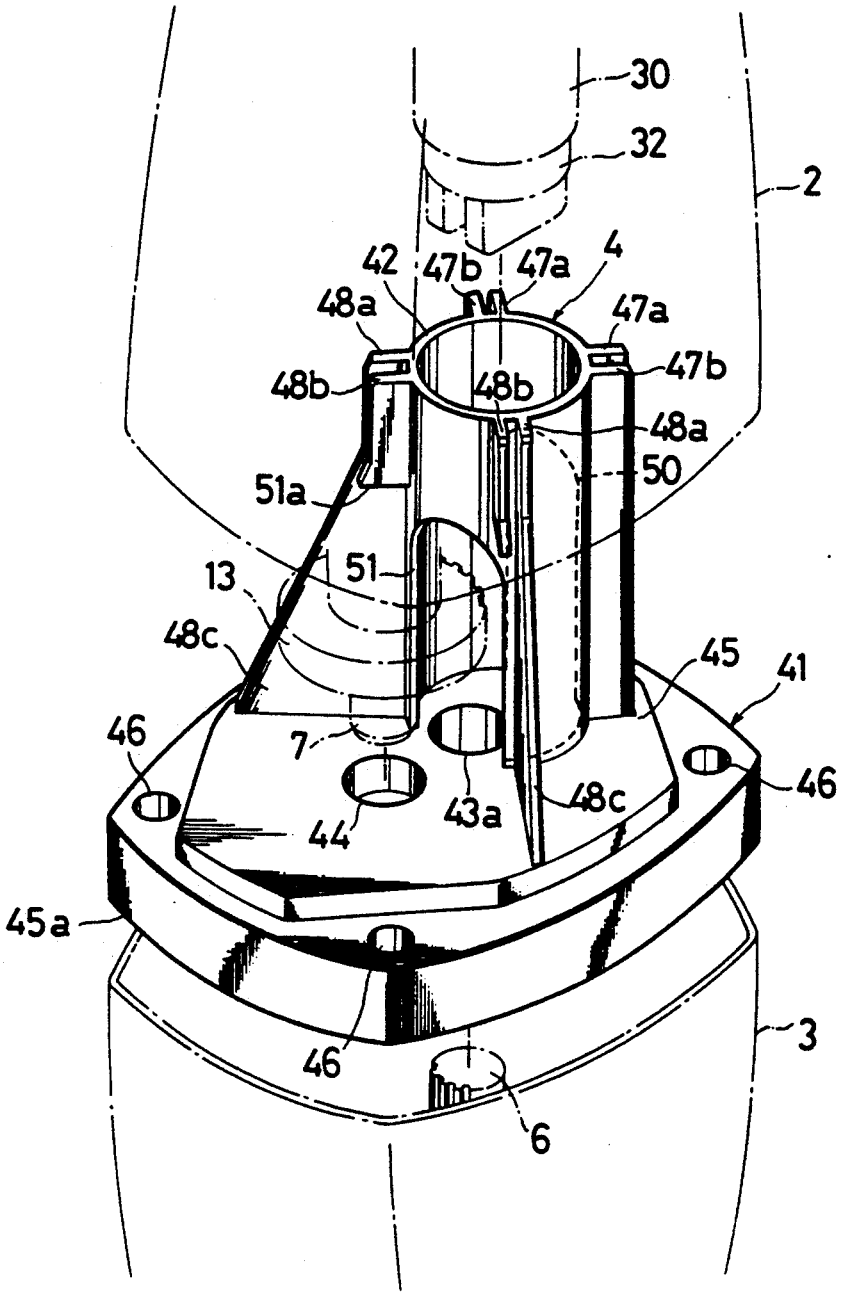
FIG. 2 is a perspective view showing one structure of an intermediate housing as a first embodiment of the invention.
Figure 3:
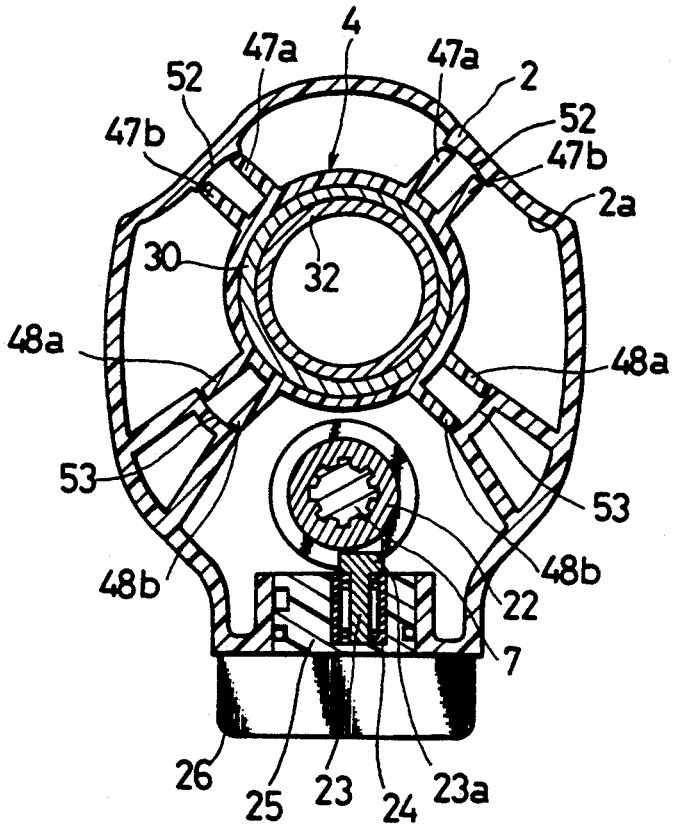
FIG. 3 is a cross sectional view showing the intermediate housing of FIG. 2 taken on the line of III—III of FIG. 1.
Figure 4:
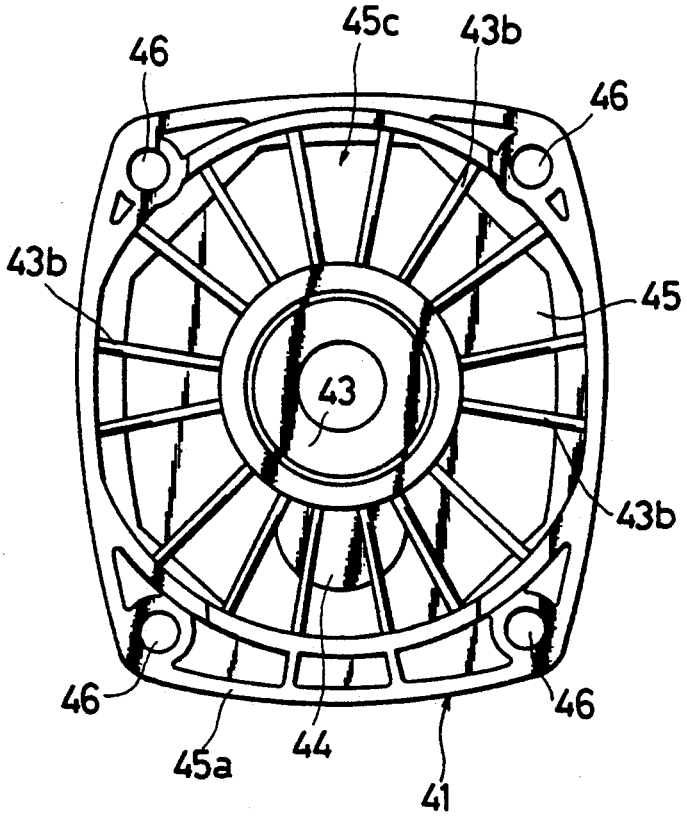
FIG. 4 is a bottom view illustrating the intermediate housing of the first embodiment.

Structure of the intermediate housing 4 is further described in detail based on the perspective view of FIG. 2, the cross sectional view of FIG. 3, and the bottom view of FIG. 4.

As clearly seen in FIG. 2, the cylindrical piston housing member 42 of the intermediate housing 4 eccentrically protrudes from the bearing member 41. The bearing member 41 includes a transverse wall 45 which has, on its approximate center, a through hole 43a of the first bearing seat 43 for supporting the armature shaft 6 of the motor 5, and the second bearing seat 44 formed below the through hole 43a for supporting the intermediate shaft 7. The intermediate housing 4 is fixed to the motor housing 3 with plural bolts (not shown) screwed into plural holes 46,46.

The piston housing member 42 has four pairs of ribs 47a,47b, 47a,47b, 48a,48b, and 48a,48b, which are radially extended from the cylindrical member 42 in four different directions as clearly seen in FIGS. 2 and 3. The piston housing member 42 also includes two arch-shaped openings 50 and 51 on upper and lower walls thereof. The upper-most ribs 47a and the second upper ribs 47b of a predetermined width are formed straight along the whole length of the piston housing member 42. The lower-most ribs 48b extend straight to an end 51a of the arch-shaped lower opening 51. The second lower ribs 48a first extend straight along the piston housing member 42 and then gradually spread to form substantially trapezoidal projections 48c, which connect with the transverse wall 45 of the bearing member 41. A pair of first seats 52,52 and a pair of second seats 53,53 are respectively formed on upper and lower portions of an inner face 2a of the gear housing 2 for supporting the intermediate housing 4 as shown in FIG. 3. The first seats 52,52 face to the two pairs of upper ribs 47a,47b with a little space held therebetween while the second seats 53,53 facing to the two pairs of lower ribs 48a,48b with a little space held therebetween.

The transverse wall 45 of the bearing member 41 is provided with a side wall 45a, which is disposed between the gear housing 2 and the motor housing 3 and exposed to the atmosphere as clearly seen in FIG. 1. The transverse wall 45 and the side wall 45a form a recess including a cylindrical opening 45c on the bottom of the intermediate housing 4 as shown in FIG. 4. In the cylindrical opening 45c, a plurality of reinforcing plates 43b,43b are radially extended from the first bearing seat 43 formed on the center of the bottom of the intermediate housing 4.

In the power driven hammer drill 1 including the intermediate housing 4 thus constructed, a rotating force of the motor 5 is transmitted first to the intermediate shaft 7 via the armature shaft 6 and the first gear element 13 and then to the third gear element 36 via the second gear element 27. The rotary movement of the third gear element 36 is further transmitted to the tool holder 30 so as to rotate the tool bit B held in the tool holder 30 via a roller 80.

When the switching lever 26 is rotated clockwise, the head 23a of the eccentric pin 23 engaging with the track 21 of the clutch 22 moves the clutch 22 backward (rightward in FIG. 1). At this moment, the first clutch teeth 22a of the clutch 22 engage with the first engagement claws 19 of the boss member 15 to transmit a rotary movement of the intermediate shaft 7 to the boss member 15. The rotary movement of the boss member 15 is then converted to an axially reciprocating movement of the piston cylinder 32 through functions of the plurality of balls 16, the ring 17, the wobble arm 18, and the piston pin 18a. The reciprocating movement of the piston cylinder 32 generates a likewise axial to-and-fro movement of the striker 34 through an air cushion formed between the air chamber 33 and the striker 34, and is finally transmitted via the percussive element 31 to the tool bit B as an axial impact force. Namely, in this lever position, the tool bit B is given both a rotary force and an impact force.

When the switching lever 26 is rotated counterclockwise, on the other hand, the second clutch teeth 22b of the clutch 22 engage with the second engagement claws 28 of the second gear element 27 while the first clutch teeth 22a are released from the first engagement claws 19 of the boss member 15. The disengagement of the clutch teeth 22a stops the axial reciprocating movement of the piston cylinder 32, so that the clutch 22 gives only a rotary force to the tool bit B via the tool holder 30.

In the above operating conditions, the cylindrical piston housing member 42 of the intermediate housing 4 holds the rotating tool holder 30 and the reciprocating piston cylinder 32. Although a relatively large stress including vibration is applied onto the piston housing member 42, the four pairs of ribs 47a, 47b, 48a, and 48b protruding from the piston housing member 42, in cooperation with the first seats 52 and the second seats 53 of the gear housing 2 for supporting the ribs 47a, 47b, 48a, and 48b with a certain space held therebetween, effectively improves durability of the intermediate housing 4 composed of a synthetic resin. Especially the glass fiber-reinforced polyamide resin used in the embodiment has sufficient wear and heat resistance and high tenacity, which are comparable to those of aluminum or other metals used for a conventional intermediate housing. The substantially trapezoidal projections 48c of the second lower ribs 48a efficiently absorb a stress applied downward perpendicularly to an axis of the piston housing member 42 of the intermediate housing 4. The arch-shaped upper and lower openings 50 and 51 of the piston housing member 42 prevent the downward stress from being locally applied onto the lower ribs 48a and 48b, but deliver the stress equally to all the ribs 47a, 47b, 48a, and 48b.

As described above, the intermediate housing 4 of the first embodiment is integrally composed of a synthetic resin. This structure efficiently saves labor and cost required for manufacturing a conventional intermediate housing composed of a metal, and reduces the weight of the power driven hammer drill 1. The synthetic resin of the outer-most part of the intermediate housing 4 exposed to the atmosphere effectively prevents electric shocks and allows easy and safe operation of the power driven hammer drill 1.

Although the intermediate housing 4 of the first embodiment includes the four pairs of ribs 47*a*, 47*b*, 48*a*, and 48*b* as described above, another structure or number of ribs may be applied as long as they are disposed near the inner wall of the gear housing and support the intermediate housing 4.

In the power driven hammer drill constructed as above, rotary movement of the tool holder and reciprocating movement of the piston cylinder naturally generate heat in the piston housing member of the intermediate housing, which may cause thermal deformation of the piston housing member in continuous operation. The piston housing member significantly deformed can not securely support the tool holder or the piston cylinder and may damage the functions of the power driven hammer drill.

FIGS. 5 through 8 show an intermediate housing 104 according to a second embodiment of the invention, which is incorporated in the power driven hammer drill 1 of FIG. 1. The intermediate housing 104 of the second embodiment has a similar structure to the intermediate housing 4 of the first embodiment, and thereby only different parts are described below. In FIGS. 5 through 8, the same numerals as those of FIGS. 1 through 4 show the same elements.

Figure 5:
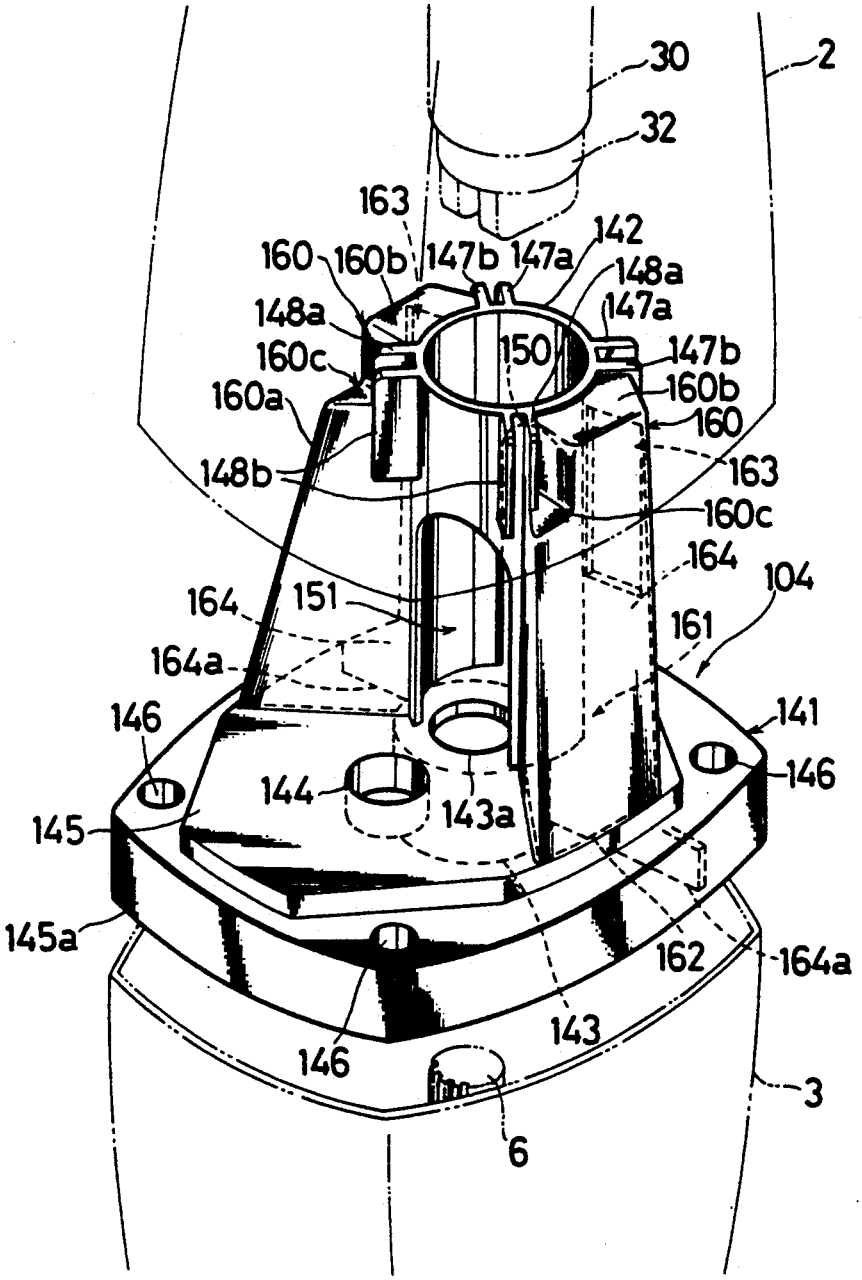
FIG. 5 is a perspective view showing another structure of an intermediate housing as a second embodiment of the invention.

As clearly seen in the perspective view of FIG. 5, the intermediate housing 104 of the second embodiment consists of a bearing member 141 and a cylindrical piston housing member 142, which are integrally composed of a glass fiber-reinforced polyamide resin as the intermediate housing 4 of the first embodiment. The bearing member 141 has a first bearing seat 143 on the approximate center thereof, and a second bearing seat 144 arranged below the first bearing seat 143.

The cylindrical piston housing member 142 of the intermediate housing 104 eccentrically protrudes from the bearing member 141. The bearing member 141 includes a transverse wall 145 which has, on its approximate center, a through hole 143*a* of the first bearing seat 143 for supporting the armature shaft 6, and the second bearing seat 144 formed below the through hole 143*a* for supporting the intermediate shaft 7 (not shown in FIG. 5). The intermediate housing 104 is fixed to the motor housing 3 with plural bolts (not shown) screwed into plural holes 146,146.

Figure 6:
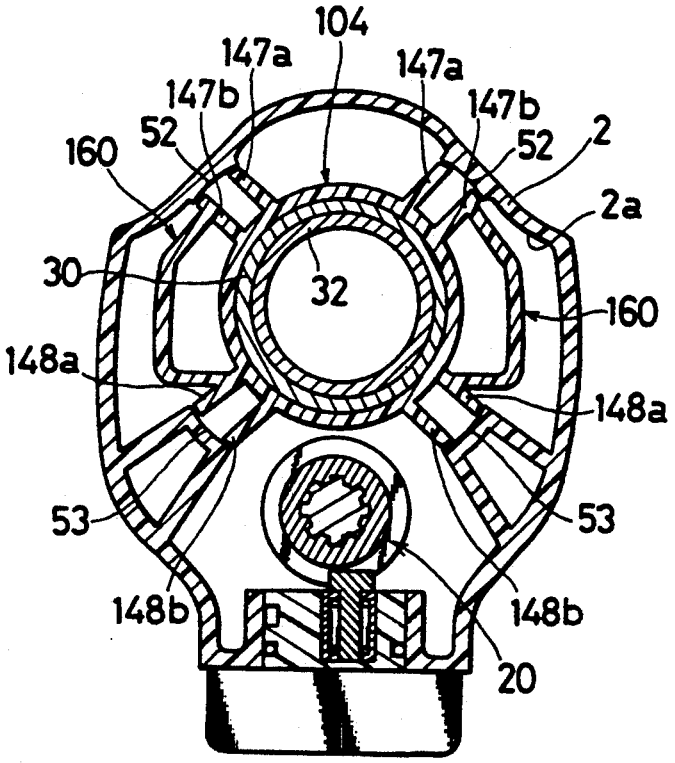
FIG. 6 is a cross sectional view showing the intermediate housing of FIG. 5 taken on the same position as FIG. 3.
Figure 7:
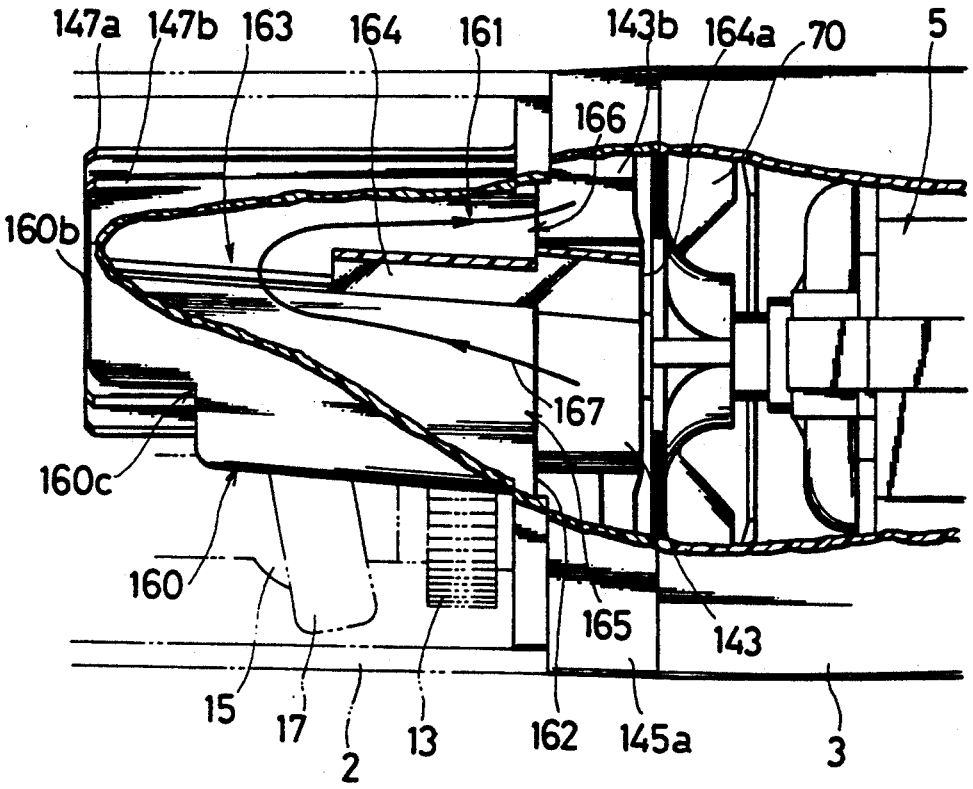
FIG. 7 shows the air flow in the intermediate housing of the second embodiment.

The piston housing member 142 has four pairs of ribs 147*a*,147*b*, 147*a*,147*b*, 148*a*,148*b*, and 148*a*,148*b*, which are radially extended from an outer face of the cylindrical member 142 in four different directions as clearly seen in FIGS. 5 and 6. The piston housing member 142 also includes two arch-shaped openings 150 and 151 on upper and lower walls thereof. The upper-most ribs 147*a* of a predetermined width are formed straight along the whole length of the piston housing member 142. Each of the second upper ribs 147*b* disposed in parallel with the upper-most ribs 147*a* is integrally formed with a thicker wall portion 160 (described later) as one side wall thereof. The lower-most ribs 148*b* extend straight to an end of the arch-shaped lower opening 151. The second lower ribs 148*a* are partly integral with the thicker wall portion 160 as the other side wall thereof. A pair of first seats 52,52 and a pair of second seats 53,53 are respectively formed on upper and lower portions of an inner face 2*a* of the gear housing 2 for supporting the intermediate housing 104 as shown in FIG. 6. The first seats 52,52 face to the two pairs of upper ribs 147*a*,147*b*,147*a*,147*b*, with a little space held therebetween while the second seats 53,53 facing to the two pairs of lower ribs 148*a*,148*b*,148*a*,148*b* with a little space held therebetween.

The transverse wall 145 of the bearing member 141 is provided with a side wall 145*a*, which is disposed between the gear housing 2 and the motor housing 3 in the power driven hammer drill 1 and exposed to the atmosphere. The transverse wall 145 and the side wall 145*a* form a recess including a cylindrical opening 145*c* on the bottom of the intermediate housing 104 as shown in the bottom view of FIG. 8. In the cylindrical opening 145*c*, a plurality of reinforcing plates 143*b*,143*b* are radially extended from the first bearing seat 143 of the intermediate housing 104.

Figure 8:
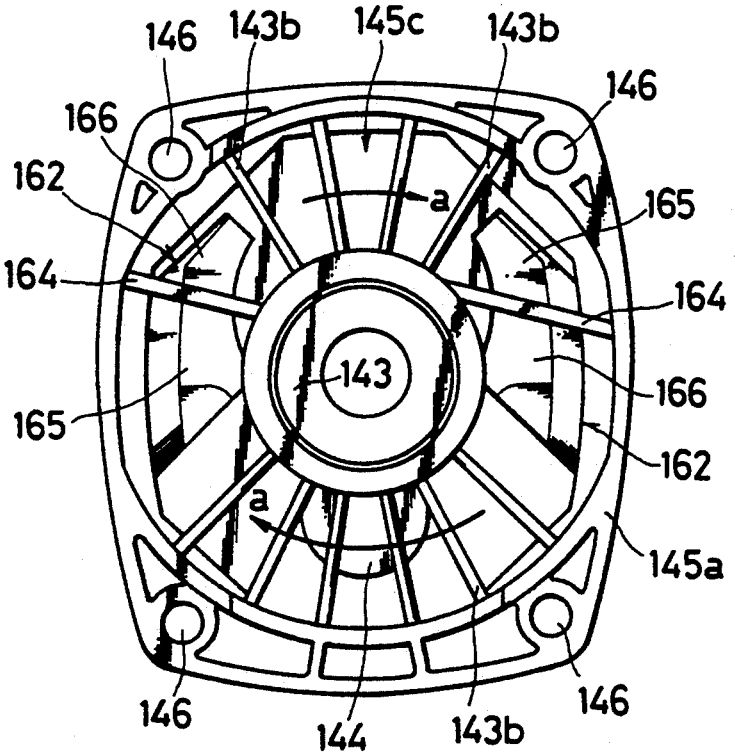
FIG. 8 is a bottom view illustrating the intermediate housing of the second embodiment.
Figure 9:
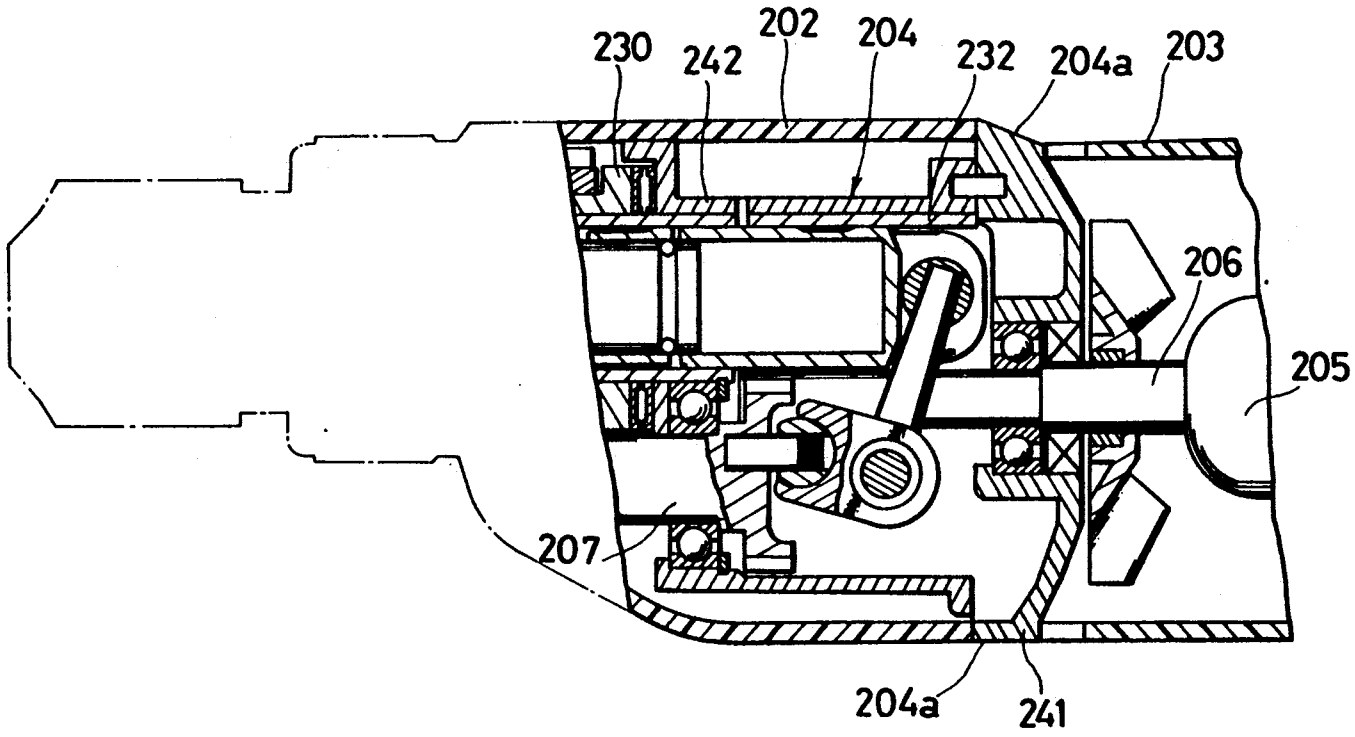
FIG. 9 PRIOR ART
FIG. 9 is a sectional view showing an intermediate housing used in a conventional power driven hammer drill.

Each of the thicker wall portions 160,160 arranged between the second upper ribs 147*b* and the second lower ribs 148*a* in the piston housing member 142 consists of an outer face of the piston housing member 142, an outer wall 160*a*, the ribs 147*b* and 148*a*, and a top wall 160*b* as shown in FIG. 5. Each thicker wall portion 160 includes a stepped section 160*c* in the part connecting to the second lower rib 148*a* to ensure a space for the second seat 53 corresponding to the second lower rib 148*a*. As clearly seen in FIGS. 5 and 7, each thicker wall portion 160 has a hollow 161, which extends through the bearing member 141 and forms an open face 162 facing to the motor 5. The hollow 161 includes an upper portion 163, an air inlet 165, and an air outlet 166. The air inlet 165 is separated from the air outlet 166 by a partition plate 164 arranged in the hollow 161. Rear ends 164*a* of the partition plates 164 extend between the side wall 145*a* and the first bearing seat 143 to divide the cylindrical opening 145*c* into two parts as shown in FIG. 8. As described above, in each of the thicker wall portions 160 of the intermediate housing 104, the air inlet 165 connects with the air outlet 166 through the upper portion 163 of the hollow 161 to form a U-shaped air conduit 167.

The power driven hammer drill 1 including the intermediate housing 104 of the second embodiment is worked in the same manner as the hammer drill with the intermediate housing 4 of the first embodiment.

In operation of the power driven hammer drill 1, the cylindrical piston housing member 142 of the intermediate housing 104 holds the rotating tool holder 30 and the reciprocating piston cylinder 32. Friction due to the rotating and reciprocating movement causes undesirable heat in the piston housing member 142. An air flow generated by rotation of a fan 70 (see FIGS. 1 and 7) sufficiently cools the motor 5 and is introduced into the bottom of the bearing member 141 of the intermediate housing 104 as shown by the arrow 'a' of FIG. 8. The air flow enters the hollows 161,161 formed in the thicker wall portions 160,160 through the air inlets 165,165 of the open faces 162,162, passes through the air conduits 167,167, and goes out of the air outlets 166,166. The air flow circulates in the thicker wall portions 160,160 in the above manner and continuously cools the cylindrical piston housing member 142 to prevent overheat of the piston housing member 142 and the bearing member 141. This structure of the embodiment efficiently prevents thermal deformation of the piston housing member 142 in continuous operation of the power driven hammer drill 1.

Although a relatively large stress is applied onto the intermediate housing 104 due to movements of the piston cylinder 32 and the tool holder 30, the four pairs of ribs 147*a*, 147*b*, 148*a*, and 148*b* protruding from the piston housing member 142, in cooperation with the first seats 52 and the second seats 53 of the gear housing 2 for supporting the ribs 147*a*, 147*b*, 148*a*, and 148*b* with a certain space held therebetween, effectively improves durability of the intermediate housing 104 composed of a synthetic resin. The pair of thicker wall portions 160,160 attached to the piston housing member 142 further improve the strength of the piston housing member 142 and the bearing member 141.

Although the intermediate housing 104 of the second embodiment includes the four pairs of ribs 147*a*, 147*b*, 148*a*, and 148*b* as described above, another structure or number of ribs may be applied as long as they are disposed near the inner wall of the gear housing and support the intermediate housing 104. Another structure with no ribs may also be applicable when the piston housing member 142 is sufficiently supported by the thicker wall portions 160,160.

The thicker wall portion attached to the piston housing member may have another shape or size according to the requirements. Although each thicker wall portion has one air inlet and an air outlet in the above embodiment, it may have a plurality of inlets and outlets. The shape, orientation, and position of the partition wall disposed in the thicker wall portion may also be altered according to the requirements. The structure of the second embodiment is applicable to a metal intermediate housing as well as that of the synthetic resin.

There may be many other alterations, changes, and modifications without departing from the scope or spirit of essential characteristics of the invention. It is thus clearly understood that the above embodiments are only illustrative and not restrictive in any sense. The spirit and scope of the present invention is limited only by the terms of the appended claims.

What is claimed is:

1. A power driven hammer drill comprising an electric motor, a tool holder for supporting a tool bit and for transmitting a rotation of said electric motor to said tool bit by way of a driving mechanism, said driving mechanism including an intermediate shaft, a piston cylinder slidably movable along an axis of said power driven hammer drill, an air cushion percussive mechanism for converting said rotation of said electric motor to a reciprocating movement of said piston cylinder and for transmitting said reciprocating movement to said tool bit as an axial impact force, and an externally accessible switching mechanism for switching off said air cushion percussive mechanism, said power driven hammer drill further including an intermediate housing disposed between a gear housing and a motor housing and having a bearing member for supporting an armature shaft of said electric motor and said intermediate shaft, and a piston housing member for holding said tool holder and said piston cylinder, said bearing member and said piston housing member being integrally composed of a synthetic resin, said intermediate housing including a plurality of ribs radially extending from an outer face of said piston housing member and being integrally formed thereon, said plurality of radially extending ribs facing an inner wall of said gear housing and being selectively radially spaced from said inner wall.

2. The power driven hammer drill of claim 1, wherein said synthetic resin comprises a glass fiber-reinforced polyamide resin.

3. A power driven hammer drill comprising an electric motor, a fan for cooling said electric motor, a tool holder for supporting a tool bit and for transmitting a rotation of said electric motor to said tool bit by way of a driving mechanism, said driving mechanism includes an intermediate shaft, a piston cylinder slidably movable along an axis of said power driven hammer drill, an air cushion percussive mechanism for converting said rotation of said electric motor to a reciprocating movement of said piston cylinder and for transmitting said reciprocating movement to said tool bit as an axial impact force, and an externally accessible switching mechanism for switching off said air cushion percussive mechanism, said power driven hammer drill further including an intermediate housing disposed between a gear housing and a motor housing, said intermediate housing including a bearing member for separating said gear housing from said motor housing and for supporting an armature shaft of said electric motor and said intermediate shaft, and a piston housing member extending from said bearing member for holding said tool holder and said piston cylinder, said bearing member having at least one opening for feeding an air flow generated by said fan to said piston housing member, and said piston housing member having at least one air conduit for circulating said air flow through said opening.

4. A power driven hammer drill in accordance with claim 3, wherein said cylindrical piston housing member comprises an outer face having formed thereon at least one wall portion, said wall portion including a hollow inside connecting with said opening of said bearing member and forming said air conduit for circulating said air flow through said opening.

5. A power driven hammer drill in accordance with claim 4, wherein said hollow wall portion forming an air inlet, an air outlet, and an intermediate opening, said air inlet being separated from said air outlet by a partition plate to form said air conduit.

6. A power driven hammer drill in accordance with claim 5, wherein said air conduit has a substantially U-shape configuration.

7. A power driven hammer drill in accordance with claim 3, wherein said bearing member and said cylindrical piston housing member are integrally composed of a synthetic resin.

8. A power driven hammer drill in accordance with claim 7, wherein said synthetic resin comprises glass fiber-reinforced polyamide resin.

9. A power driven hammer drill in accordance with claim 3, wherein said intermediate housing further comprises a plurality of ribs radially extending from an outer face of said cylindrical piston housing member and being integrally formed thereon, said plurality of ribs facing to an inner wall of said gear housing and being selectively radially spaced from said inner wall.

* * * * *